US008162533B2

(12) United States Patent
Hayabusa

(10) Patent No.: US 8,162,533 B2
(45) Date of Patent: Apr. 24, 2012

(54) MIXING METHOD FOR POWDER MATERIAL AND LIQUID MATERIAL, AND MIXER

(75) Inventor: Naganobu Hayabusa, Chigasaki (JP); Kyoko Hayabusa, legal representative, Chigasaki (JP)

(73) Assignee: Falxer Co., Ltd., Chigasaki-shi (JP)

( * ) Notice: Subject to any disclaimer, the term of this patent is extended or adjusted under 35 U.S.C. 154(b) by 864 days.

(21) Appl. No.: 10/582,244

(22) PCT Filed: Mar. 22, 2005

(86) PCT No.: PCT/JP2005/005135

§ 371 (c)(1),
(2), (4) Date: Oct. 1, 2008

(87) PCT Pub. No.: WO2006/011266

PCT Pub. Date: Feb. 2, 2006

(65) Prior Publication Data

US 2009/0016148 A1 Jan. 15, 2009

(30) Foreign Application Priority Data

Jul. 27, 2004 (JP) ..... 2004-241680

(51) Int. Cl.
*B01F 15/00* (2006.01)
*B01F 7/00* (2006.01)

(52) U.S. Cl. ..... 366/175.3; 366/169.1; 366/169.2; 366/170.1; 366/170.2; 366/307

(58) Field of Classification Search ..... 366/169.1, 366/169.2, 170.1, 170.2, 307
See application file for complete search history.

(56) References Cited

U.S. PATENT DOCUMENTS

| | | | | |
|---|---|---|---|---|
| 19,610 | A * | 3/1858 | Perry et al. | 426/498 |
| 1,501,527 | A | 7/1924 | Darrah | |
| 5,158,782 | A | 10/1992 | Hayashi et al. | |

FOREIGN PATENT DOCUMENTS

| | | |
|---|---|---|
| DE | 198 57 775 | 6/2000 |
| JP | 62-1445 | 1/1987 |
| JP | 8-238051 | 9/1996 |
| JP | 200129765 | 2/2001 |

OTHER PUBLICATIONS

Search Report and Written Opinion from related PCT application.
Search Report from corresponding European Application No. 05727023.3 dated Feb. 1, 2011.

* cited by examiner

*Primary Examiner* — Nathan Bowers
*Assistant Examiner* — Gautam Prakash
(74) *Attorney, Agent, or Firm* — Grossman, Tucker, Perreault & Pfleger, PLLC

(57) ABSTRACT

A mixer of the present invention includes an outer cylinder into which powder material is loaded, a rotational axis which is located coaxially with the outer cylinder and discharges liquid material while forming the liquid material to fine particles, and a fin which has a rectangular shape and is disposed along an inner wall of the outer cylinder. The fin is independently revolvable around the rotational axis. The fin has side faces in a direction of revolution of the fin, each of which forms an inclined face such that a width of the fin becomes wider from an inner surface to an outer surface of the fin.

5 Claims, 2 Drawing Sheets

MIXING METHOD FOR POWDER MATERIAL AND LIQUID MATERIAL, AND MIXER

TECHNICAL FIELD

The present invention relates to technology of a method for uniformly adding or mixing liquid material into powder material, and a mixer.

Ever since wheat flour was first used by milling it to obtain dough for making bread or noodles, people have made the dough using a method of adding water into wheat flour and mixing, spending many hours to do so. The present invention provides technology for realizing a method for uniformly mixing water in a fine particle condition and wheat flour powder from the beginning of contact therebetween, and thereby obtaining perfect dough in which water mixing is complete (i.e., in a perfect mixing state) in an extremely short mixing time of only 3.5 seconds, by adopting multiple newly developed technologies. Simultaneously, most of the problems existed with the conventional dough are solved.

BACKGROUND ART (1) Making Dough for Making Bread

In a method for performing uniform mixing when making dough for making bread using a conventional mixer for making bread such as a vertical-type mixer, a spiral mixer, or the like, in order to obtain water mixing in which powder material such as wheat flour and liquid material are uniformly mixed, non-uniformity in water mixing which occurs at the beginning of mixing of the two materials (i.e., portions which contain excessive water and portions in which the wheat flour and water are not yet mixed, both of which appear when adding water into the wheat flour) are made uniform by mixing them.

However, since a large amount of air existing within a powder materials in a fine particle condition such as wheat flour has a tendency to stick strongly onto powder material particles, it blocks liquid material moving through the powder material, thereby blocking spreading for uniformity of the liquid material. Therefore, it takes time to perform uniform mixing, and as a result, gluten is produced in the meanwhile. Thus, various kinds of gluten formations which will lower the product quality and are therefore not desired by bakers will be produced within the dough, when effecting the water mixing.

Accordingly, bakers seeking high quality have to take troublesome countermeasures to prevent producing such gluten formation or to decrease the influence of the gluten formation.

Bakeries which mass-produce cannot avoid using additives.

Some bakers who try to produce products having quality as high as possible stop using a mixer at an early stage in which the water mixing is incomplete, remove dough from the mixer, and complete the water mixing by performing manual processing of the dough. Furthermore, some bakers seeking products having higher quality avoid even using a mixer as a method for effecting water mixing.

As for a process of effecting water mixing, there is also a method in which powder material and liquid material are alternatively fed into a container or a pouch, and are left for many hours so as not to cause formation of gluten which will lower quality; and the completion of the water mixing in which the liquid material naturally disperses within the powder material is put on hold.

In this case, since many hours are required for completing the water mixing, it is maintained at a low temperature by putting it into a refrigerator in order to suppress an abnormal fermentation of yeast.

(2) Making Dough for Making Noodles

Conventional mixers for making noodles are also mixers which, whether of a batch type having low speed or a continuous type having semi-high speed, make non-uniformity in the water mixing appearing at first uniform by way of a blending-and-mixing operation.

A ratio of water to be added (equal to a ratio between the weight of wheat flour and the weight of liquid material to be added to this wheat flour) of dough for making noodles is normally equal to or less than 10% to 30% lower than that for dough for making bread itself being 30% to 50%. Thus, it is still more difficult to disperse and immerse the water within the wheat flour. Conventional mixers for making dough for making noodles cannot make non-uniformity in water mixing appearing at the beginning of adding of liquid material uniform at the time when mixing process is ended, or even at a time after performing of additional processing for increasing the uniformity of the water distribution, even in the case of using a low speed and batch type mixer or even in the case of using a semi-high speed and continuous type mixer.

However, during the mixing process or the additional process for increasing the uniformity of water distribution, by removing air within the wheat flour by vacuuming air within the wheat flour or by compressing the wheat flour, uniformity can be achieved. However, as to be mentioned later, foods in which air is removed by vacuuming the air or by compression will lose their taste and aroma. Therefore, this is not preferable for a method for making foods.

If the mixing time is made longer so as to achieve uniformity using only the mixer, the gluten formation previously formed therein will be destroyed by an applied force of blending and mixing; as a result, dough having almost no gluten formation therein, which is completely useless. This is because the amount of destroyed gluten formation which was previously formed is larger than that of gluten formation which is newly produced by continuing the mixing process.

Therefore, when making noodles using a machine, even when material which has been put into a semi-high speed and continuous type mixer is made to pass through the mixer within only 10 seconds, in order to obtain dough which is useable for making noodles, it still needs additional processing after the mixing processing, such as kneader processing which further increases uniformity by way of slow blending and mixing, leaving-and-maturation processing in which one waits for the further uniformity of water contained therein to increase after forming the dough into a belt-shape and leaving it, or the like. Such processing requires time of at least 30 minutes to 60 minutes.

When making noodles using a manual processing for making teuchi udon, tenobe men, or the like, it is removed from a mixer and is thereafter processed so as to increase the uniformity of the water-dispersion by processes such as foot-stepping processing, leaving-and-maturation processing, and the like. However, even when these processes are performed, a complete mixing state still cannot be obtained at the time immediately after the processing.

When making noodles using manual processing which uses a high water adding ratio close to 50%, water within portions where water was added excessively in the initial stage forms small pockets of free water; and the free water remains within the dough or within the noodles while forming small pieces until the last. Therefore, the dough or the noodles will have high adhesiveness. Accordingly, during the process of making noodles, making noodles had to be made while preventing the adhesiveness by painting oil or adding powder onto the dough or the noodles.

(3) Semi-High Speed-Type Mixer

A continuous type-semi-high speed blending-and-mixing mixer for making noodles (SUPER TURBO TURBULISOR, or the improved mixers thereof) is a mixer developed for the purpose of chopping portions which are mixed with excessive water (in many cases, salt water) using wings or paddles rotating at semi-high speed, at an inner wall surface of an outer cylinder; and mixing it with powder portions which were not mixed with water, and thereby performing uniform mixing within a short time. There are other mixers in which powder material and liquid material are fed from a side end of an outer cylinder; however, the way of performing uniform mixing is the same.

However, the same as the principles of a centrifugal separator, material mixed with water and therefore having higher weight will rotate along an inner wall of the outer cylinder, while powder material which was not mixed with water and therefore having lower weight will rotate at an inner side thereof. Therefore, expected contact between mixed portions and non-mixed portions does not occur, and thus, uniformity is not increased.

Accordingly, with this kind of mixer, products removed from the mixer will enter a clumpy state in which a material having a lower mixing ratio with water surrounds a material having a higher mixing ratio with water. Therefore, even though time for passing through the mixer is short, an additional process for increasing uniformity is required in order to make noodles.

There is a continuous type mixer for making noodles (FLOW JETTER) which has a horizontal disc rotating at a semi-high speed under 2,500 rounds per second onto which wheat flour and water are fed in order to spread them in every direction so as to make them fine particles and mix them. Theoretically, this mixer should be able to perform more uniform mixing of powder material and liquid material than the above-mentioned mixer.

However, in actuality, the powder material is provided unevenly towards the vicinity of a center of the disc; therefore, much unevenness occurs depending on the scattering direction of the powder material. In addition, since a part of the powder material cannot be mixed with water and scatters, there are many cases in which a dust chamber is necessary. The removed product enters a clumpy state in which portions mixed with excessive water are surrounded by portions having low-water mixing ratio. Of course, this cannot be used for making noodles without performing additional processing.

(4) Vacuum Mixer

There is a mixer called a vacuum mixer which performs blending and mixing by decompression. Since it has a function of performing blending and mixing while removing air within powder material, which prevents dispersion of liquid material, uniformity can be achieved within a comparatively short time. However, of course, air within the dough is lost. As a result, noodles having low air content are made. Therefore, as with pasta or noodles made by putting it into a cylinder, compressing it using a piston, and extruding it from a die while removing air, noodles made by the mixer will become noodles in which taste and smell of the material are poorly experienced regardless of the quality of the material.

This is because the human taste bud feels the taste when air and taste-constituent contained in foods intermittently stimulate the taste bud.

Accordingly, it must be said that making dough using this kind of mixer and making noodles by applying high-pressure cause problems when used as methods for making foods for which taste and flavor are important.

Furthermore, since air is removed, it becomes hard; thereby causing the speed of water immersion into pasta or noodles to become slow. The water is indispensable for alpha-forming when boiling them. Therefore, there is another problem in that time for boiling becomes longer.

DISCLOSURE OF THE INVENTION

Problems to be Solved by the Invention

The present invention has a purpose of achieving the following (a) to (f) by solving problems of the conventional mixing technologies such as those mentioned above.

(a) To enable obtaining of dough for making bread and dough for making noodles in a short time, in which water mixing (i.e., complete mixing state) is complete, regardless of the existence of a large amount of air within powder material.

(b) To enable obtaining of dough for making bread in which blending and mixing are not performed during a process of water mixing, and which therefore does not contain gluten formation which is inconvenient for making bread.

(c) To enable making of noodles using dough immediately after it is removed from a mixer.

(d) To enable obtaining of dough from dough having a low mixing rate with liquid material within a short time using the apparatus.

(e) To enable obtaining of a derivative or a mixture within a short time without performing blending and mixing. The derivative or the mixture is made by liquid material and powder material or chemicals which hate blending and mixing and long-hour-processing.

(f) To develop processes for achieving the above-mentioned (a) through (e) applicable to both a batch type which is suitable for small amount production and a continuous type which is suitable for mass production.

Means for Solving the Problem

The present invention was made to accomplish the above-mentioned objects, and adopts the following means.

That is, a first aspect of a mixer of the present invention is that a powder material and a liquid material are combined by adding the liquid material from a side of a rotational axis to the powder material when it is spreading and revolving along an inner wall surface of an outer cylinder, the liquid material being processed to a fine particle having a size which does not need to move and combine with the new powder material after combining with the powder material; and an inertial classification operation in which the powder material combined with the liquid material is moved to the inner wall side of the outer cylinder, while the powder material not combined with the liquid material is moved toward the rotational axis side, or the powder material having a high degree of combining with the liquid material is moved to the inner wall surface side of the outer cylinder, while the powder material having a low degree of combining with the liquid material is moved toward the rotational axis side.

It may be arranged for the mixer to further include a fin which is provided around the rotational axis and is independently revolvable, wherein the fin has a bottom face extending along the inner wall surface of the outer cylinder, a low thickness, and a width which is not too wide in the rotational direction; and the fin itself has little function of pressing and forwarding the powder material, but the powder material riding on the fin spreads along the inner wall surface of the outer cylinder by being replaced by the powder material on the inner wall surface of the outer cylinder.

In addition, a second aspect of a mixer of the present invention is that in a mixer which combines a powder material and a liquid material; the mixer includes an outer cylinder into which the powder material is loaded, a rotational axis which is located coaxially with the outer cylinder and discharges the liquid material while forming the liquid material into fine particles, and a fin which has a rectangular shape and is disposed along an inner wall of the outer cylinder. The fin is independently revolvable around the rotational axis; and the fin has side faces in a rotational direction of the fin, each of which forms an inclined face such that a width of the fin becomes wider from an inner surface to an outer surface of the fin.

The mixer may be provided with a fin which is orthogonal to a direction of revolution of the powder material, and traverses the outer cylinder along the inner wall surface of the outer cylinder.

The mixer may be provided with a fin which forms a non-vertical with respect to a direction of revolution of the powder material, and traverses the outer cylinder along the inner wall surface of the outer cylinder.

It may be so arranged that a cylinder forming the rotational axis includes an opening through which an outside and an inside of the cylinder communicate, and a liquid film made of the liquid material is discharged using a centrifugal force in order to obtain fine particles made of the liquid material; and the fine particles of the liquid material are obtained by discharging the liquid film from an edge of the opening.

It may be so arranged that a plurality of cylinders, each having through holes formed on a wall surface through which the liquid material passes, are combined inside the cylinder having the opening; the number of the through holes increases when approaching to the outer-most cylinder; the liquid amount of the liquid material is divided by the through holes of which the number thereof increases while the liquid material supplied from the inner-most cylinder on an inside is moved toward the cylinder on the outside through the through holes by a centrifugal force accompanying rotation of the cylinders; and the fine particles of the liquid material are obtained by discharging the liquid film from the edge of the opening of the outer-most cylinder.

A method of combining a powder material and a liquid material of the present invention is one in which a powder material and a liquid material are combined by adding the liquid material from a side of a rotational axis to the powder material while it is spreading and revolving along an inner wall surface of an outer cylinder, the liquid material being processed to a fine particle having a size which does not need to move and combine with the new powder material after combining with the powder material; and an inertial classification operation in which the powder material combined with the liquid material is moved to the inner wall side of the outer cylinder, while the powder material not combined with the liquid material is moved toward the rotational axis side, or the powder material having a high degree of combining with the liquid material is moved to the inner wall surface side of the outer cylinder, while the powder material having a low degree of combining with the liquid material is moved toward the rotational axis side.

Operations according to the present invention will be described in the following.

(a) Fins were developed which can spread and forward a powder material along an inner wall of an outer cylinder without blending or mixing. For example, as indicated by symbols 2 and 3 in the cross sectional view of FIG. 1 and in the side configuration view of FIG. 2, the fins may have an extremely simple configuration. Using the fins, the powder material loaded into the outer cylinder is spread and revolved along the inner wall of the outer cylinder.

(b) In order not to rely on diffusion or infiltration phenomenon which is physically difficult and is time-consuming (i.e., diffusion or infiltration phenomenon in which an excessive liquid material within a temporally formed combining product of the powder material and the liquid material moves to an uncombined powder material or to combining product having the lower degree of combining and combines with it, while opposing against resistance of air existing among the powder material), the liquid material is made to fine particles having fineness in which the liquid material temporally combined with the powder material does not have necessity of moving to the other. The liquid material in the form of fine particles is added so as to be discharged from the side of the rotational axis to a whole surface of the powder material spreading and revolving along the inner wall of the outer cylinder.

(c) The degree of fine particles of the liquid material cannot be achieved by the conventional mixers.

(d) Due to centrifugal action based on the first law of motion, a combined product combined with liquid material and having an increased weight moves to the inner wall surface side of the cylinder, while the uncombined powder material revolves on the rotational axis side which is an inner side. With this kind of centrifugal action, the powder material combined with the liquid material and the uncombined powder material are separated. This separation is accomplished within a short time.

(e) In order to perform this kind of separation, a fine-processing apparatus for a liquid material was developed, which can discharge a liquid material to the entire surface of revolving powder material by spreading, within a short time, the liquid material of a necessary amount and being sufficiently particulate from the rotational axis side along the inner wall surface of the outer cylinder, such that the liquid material which temporally combines with the powder material does not need to move again towards the other. This is because, in the case of powder materials such as wheat flour, having a characteristic of forming wet gluten when combining with liquid material and subsequently being organized by combination between the glutens, swapping of the powder material particles on the inner wall side of the outer cylinder and those on close to the rotational axis side happens less, if many hours have passed.

Advantageous Effects of the Invention

According to the present invention, a process of making bread and a process of making noodles are greatly quickened; and especially, in the process of making noodles, processing time will be shortened to, at least as low as less than 1/1200. This is because additional processes for increasing the uniformity of distribution of water after the mixing-process become completely unnecessary. Furthermore, an advantage in facility cost reduction is also extremely effective since no kneader apparatus or compressing and couching and maturation apparatus, which have been utilized for performing additional processing are necessary.

When making teuchi udon or making tenobe men, no foot-stepping processing which takes close to 20 minutes after a mixing process, or couching-and-maturation process are necessary. Therefore, there is no need to begin making dough many hours before making noodles. Accordingly, one can begin making dough when one desires. The advantages in industrial application are extremely high.

Blending and mixing, and a process requiring many hours are not suitable for mixing and combining powder material of a drug or industrial material and liquid material. Therefore, the usefulness of the present invention, which enables complete mixing and combining within a short time, and does not have blending-and-mixing effect, is high in industrial fields where mixtures or combinations are required.

By combining with a technology for making noodles disclosed in Japanese Unexamined Patent Application, First Publication No. 2004-337141 which has already been separately filed, making of noodles such as pasta or noodles having high quality and many characteristics which have not been presented so far can be made possible to accomplish with a small apparatus which has not existed thus far; accordingly, great change and advance in the industrial field of making noodles are enabled.

The mixer of the present invention has simple structure; therefore, disassembling and assembling thereof are easy. Thus, maintenance and cleaning thereof are also easy. Accordingly, usefulness in industrial application is extremely high.

EXPLANATION OF REFERENCE NUMERALS

Figure 1:
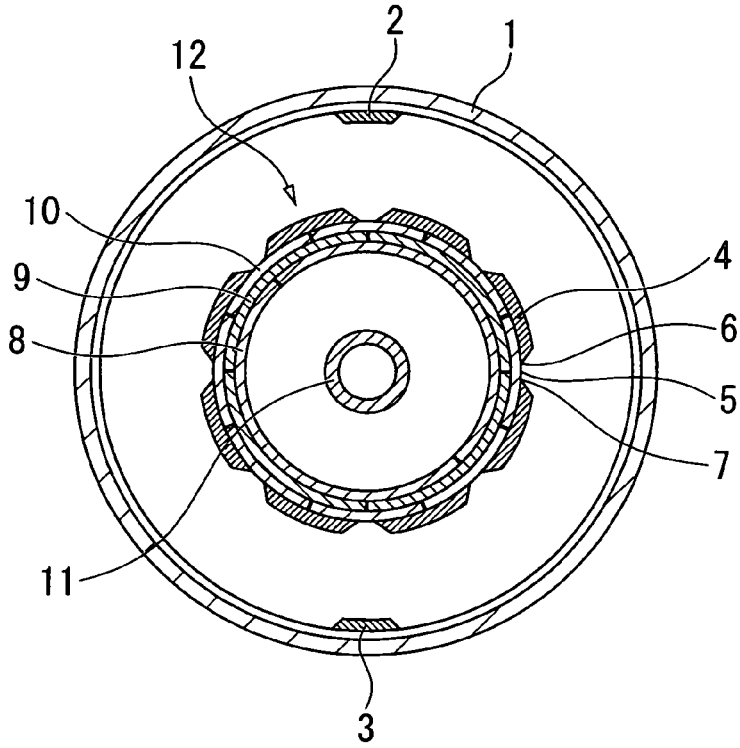
FIG. 1 is a figure showing one embodiment of a mixer of the present invention, and is a cross-sectional view on a cross section which is perpendicular to a rotational axis line.

"1" denotes an outer cylinder for spreading and revolving powder material along an inner wall of the outer cylinder.

"2" denotes fins for spreading and revolving the powder material along the inner wall of the outer cylinder.

"3" denotes a fin for spreading and revolving the powder material positioned on the opposite side along the inner wall of the outer cylinder with respect to the outer cylinder 1.

"4" denotes a cylinder provided with slits. In an example shown in the cross-sectional views of FIGS. 1 and 2, eight slits are provided.

"5" denotes one of the slits.

"6" denotes an edge formed at a position where the slit 5 and an inner wall surface of the cylinder 4 meet.

"7" denotes, the same as the edge 6, an edge formed at a position where the slit 5 and the inner wall surface of the cylinder 4 meet.

"8" denotes a cylinder having through holes for distributing liquid material in proper quantities.

"9" denotes a cylinder having through holes for distributing liquid material in proper quantities. It is adjacent to an outer side of the cylinder 8.

"10" denotes a cylinder having through holes for distributing liquid material in proper quantities. It is adjacent to an outer side of the cylinder 9. Moreover, in FIG. 1, in order to show them in the figure, each of the cylinders 4, 8, 9, and 10 is shown as if they are in close contacts each other; however, in actuality, between these cylinders 4, 8, 9, and 10, gaps are provided through which the liquid material passes.

"11" denotes a supply tube for supplying the liquid material coming from the exterior to a center portion of the cylinder 8. Although not shown in FIGS. 1 and 2, through holes are provided to each of the cylinders 8, 9, and 10, for sequentially distributing the liquid material provided within the center portion of the cylinder 8 along the length of the cylinder.

BEST MODE FOR CARRYING OUT THE INVENTION

In a conventional method for revolving powder material along an inner wall of an outer cylinder, the powder material is driven by revolving a fin having a shape such as a plate shape, a rod shape, a paddle shape, or the like; or revolving a fin having a shape like a pushing-plate of a bulldozer, along an inner wall of a cylinder; or the like. However, the former one performs blending and mixing of the powder material, while the later collects the powder material on a front face of the fin.

Figure 2:
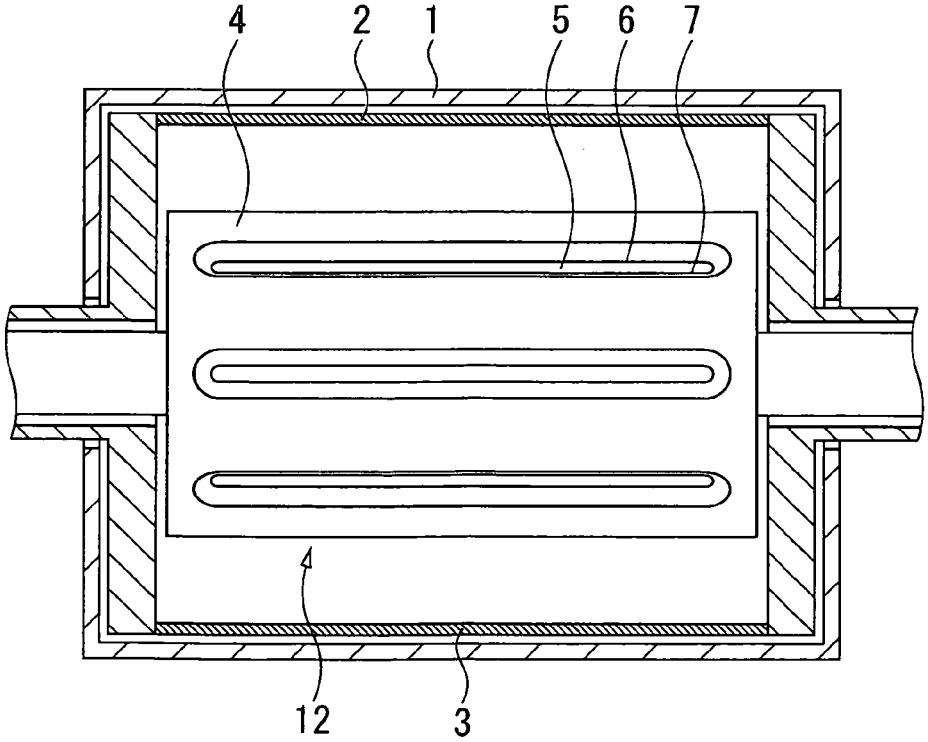
FIG. 2 is a cross-sectional view of the same mixer on a cross-sectional face including a rotational axis thereof.
Figure 3:
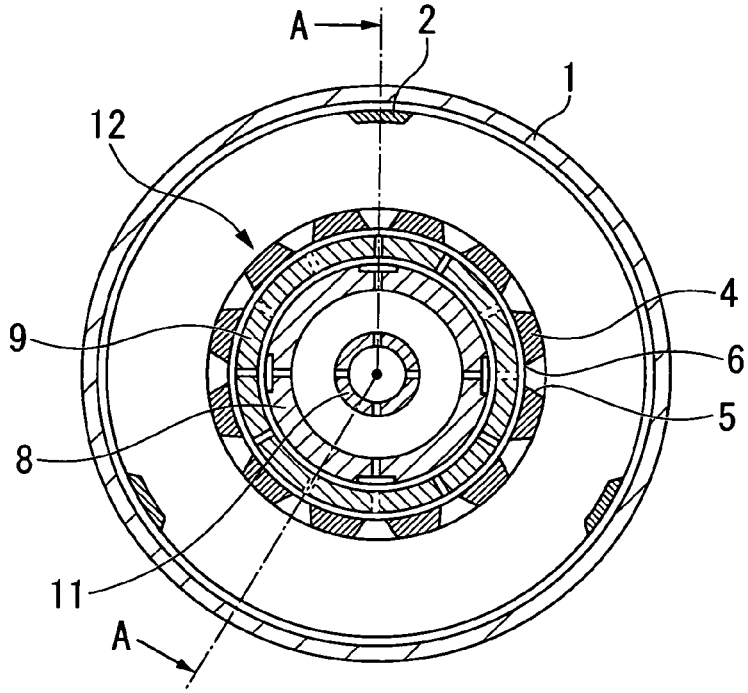
FIG. 3 is a figure showing another embodiment of a mixer according to the present invention, and is a cross-sectional view on a cross-sectional face on line B-B of FIG. 4.
Figure 4:
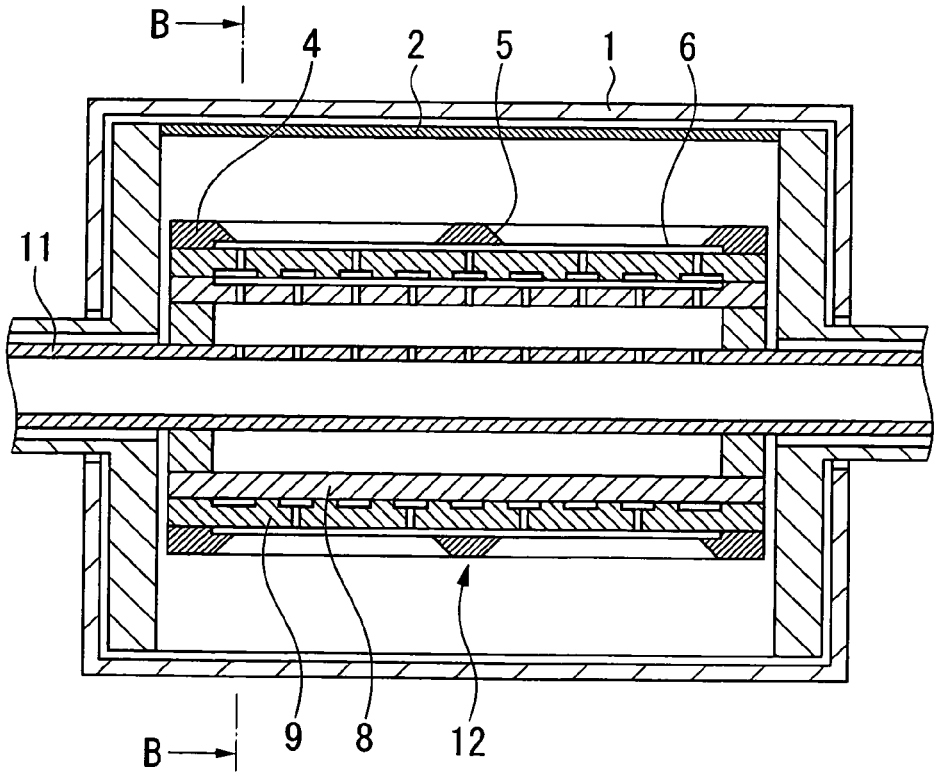
FIG. 4 is a cross-sectional view of the same mixer seen along line A-A of FIG. 3.

FIG. 1 is a figure showing one embodiment of a mixer of the present invention, and is a cross-sectional view on a cross section which is perpendicular to a rotational axis line. In addition, FIG. 2 is a cross-sectional view of the same mixer on a cross-section including a rotational axis thereof. FIG. 3 is a figure showing another embodiment of a mixer according to the present invention, and is a cross-sectional view on a cross section on line B-B of FIG. 4. FIG. 4 is a cross-sectional view of the same mixer seen along line A-A of FIG. 3.

(a) In order to uniformly spread and revolving powder material along an inner wall of an outer cylinder 1 so as not to perform blending and mixing, fins 2 and 3 are adopted which have bottom faces extending along an inner wall surface of the outer cylinder 1, which have low thicknesses, which have widths which are not too wide along the revolving direction; and which themselves have almost no function of pushing the powder material.

The fin 2 can rotate while putting a part of the powder material on a face facing a rotational axis 12. That is, the powder material rides on the face facing the rotational axis 12, forming an angle of repose which is smaller than that in the stable state. The part of powder material provided on this fin 2 pushes powder material provided on an inner wall of the outer cylinder 1, and revolves it along the inner wall of the outer cylinder 1. However, the part of powder material riding on the fin 2 does not remain on the fin 2. The powder material provided on the fin 2 will collide with the powder material provided on the inner wall surface of the outer cylinder 1; therefore, it is continuously replaced by other powder materials. In this fashion, the fin 2, which is almost flat and seems to have no function, will spread the powder material along the inner wall of the cylinder 1 and will revolve it.

The face facing the rotational axis 12 of the fin 2 which revolves the powder material needs not be a round surface which is parallel to the inner wall surface of the outer cylinder 1. It may be formed with a flat surface, or a surface having a curved face or a projection which somewhat protrudes toward the rotational axis 12. That is, any shape is applicable as long as it can proceed while putting powder material thereon.

When combination between the powder material and the liquid material begins, the powder material provided on the inner wall surface of the outer cylinder 1, and having increased weight due to combining with the liquid material, will more forcefully collide with the powder material on the fin 2. The powder material on the fin 2, having low weight, will be ejected and will be actively replaced with the powder material combined with the liquid material. In this way, the powder material revolving along the inner wall of the outer cylinder 1 and the powder material on the fin 2 can obtain uniform combination with the liquid material.

(b) The fins 2 and 3 which spread the powder material by pushing and forwarding it, can be made effective by giving them shapes which, as shown in FIG. 2, extend so as to extend along the entire length of the outer cylinder 1, and furthermore extend linearly in a direction orthogonal to the direction of revolution. These fins 2 and 3 are joined to the rotational axis 12 via supporting rods or supporting disks at both end positions of the outer cylinder 1, and are driven.

(c) If a fin 2 which extends so as to be inclined with respect to the direction of revolution is adopted, since the fin 2 can also transfer material along the length of the outer cylinder 1, it can work as a fin for a continuous type mixer.

(d) The number of the fins 2 which push and forward the powder material can be appropriately chosen depending on the size of the outer cylinder 1, and the quantity of the powder material to be processed.

However, if the number of the fins 2 for rotating the powder material is too high compared to the amount of the powder material within the outer cylinder 1, or if the amount of the powder material on the inner wall of the outer cylinder 1 is too low due to too broad a width of the fins 2 in the direction of revolution, swapping between the powder material riding on the fin 2 and the powder material positioned on the inner wall surface of the outer cylinder 1 become hardly performed.

(e) High centrifugal force is generated by, as has been shown in the embodiment, rotation in a high speed of the cylinder 4, which is driven by a driver different from that for the fin 2, and has the slits 5 for making the liquid material into fine particles, or a "fin" (not shown in the figures, but specifically explained in the following section (f)), on a periphery thereof. With this centrifugal force, the liquid material once joined with the powder material is made to fine particles which have enough preciseness in which movements to other powder material are unnecessary; thereafter, they are discharged from the slits 5 of the cylinder 4 or from the above-mentioned fin, towards the entire surface of the powder material spreading on the inner wall of the outer cylinder 1.

The cylinder 4 provided with the slits 5 or the fin needs not have a cylindrical shape; however, a cylindrical shape is the most preferable.

As shown in FIG. 1, each portion connecting with an inner wall surface of the cylinder 4 of the slits 5 has an edge-shape. From these edges 6 and 7, thin liquid films for obtaining fine particles of the liquid material, are discharged. The thin films are discharged from the edges 6 and 7 or the above-mentioned fin, and immediately become fine particles.

Moreover, formation of the edges 6 and 7 is not limited to the portions which are connected to the inner wall surface of the cylinder 4, and edges may be formed at a position which is closer to the outer wall side of the cylinder 4 than the inner wall surface of the cylinder 4.

The shape of the slits 5 which discharge fine particles of the liquid material may be that of a circle, square, or triangle, if they are used only for the purpose of discharging the liquid film; however, as shown in FIG. 2, they preferably have a shape fully extending along the length of the cylinder 4, and are arranged orthogonal to the rotational direction of the cylinder 4, and arranged at constant intervals along the rotational direction of the cylinder 4. FIG. 8 shows an example in which eight slits 5 are provided on the periphery of the cylinder 4.

(f) Instead of the slits 5, fins (not shown in the figures) which receive the supply of thin liquid film from the inner wall surface side of the cylinder 4 and discharge fine particles of the liquid material by discharging the thin liquid film of liquid material from distal ends of front faces thereof, may be provided so as to stand on the outer wall surface of the cylinder 4 while the fins face the rotational direction thereof.

Regarding the shape of this kind of fins, if they are provided only for the purpose of discharging the liquid material in a fine particle state, longer fins or shorter fins may be adopted. However, it is preferable to arrange the fins at constant intervals around the cylinder 4, and make them run the full length of the cylinder 4 and orthogonal to the rotational direction of the cylinder 4.

However, the length of the edges 6 and 7 which discharge the liquid film will be almost twice that of the fins which discharge the liquid film when comparing the case in which discharging of liquid material in the fine particle state is accomplished by providing the plurality of slits 5 running the full length along the length direction of the cylinder 4 while leaving constant gaps therebetween to the cylinder 4 having the same diameter and the same length; and the case of providing the same number of the fins running the full length of the cylinder 4 and the same width as the slits 5. The fins discharge the liquid material only from distal portions on the front surfaces thereof, thereby discharging the liquid material in the fine particle state. On the other hand, in the case of the slits 5, the liquid film is discharged from both sides of the edges 6 and 7 facing to each other, within one slit 5. That is, locations for discharging the liquid material in the fine particles can be secured in almost twice the number on the surface of the same cylinder 4.

When the cylinder is rotated at the same speed, the edges of fins provided on the cylinder 4 will be suffered from the greater centrifugal force, since the distal ends of the fins provided on the cylinder 4 are located further away from a rotational center line. However, the centrifugal force can be made the same by slightly increasing the number of rotations of the cylinder 4 having the slits 5, or by making the radius of the cylinder 4 having the slits 5 equivalent to a distance from the distal ends of the fins to the center line of the rotational axis 12.

Accordingly, for a method for discharging liquid film for obtaining fine particles of the liquid material, providing the slits 5 is preferable to providing the fins. Furthermore, it is still more preferable in mixers in which powder materials or dough is disposed therearound, since it provides a simple structure which does not have portions protruding outwards.

In order to supply an amount of liquid material adequate for discharging the thin film to the slits 5 or the fins, three cylinders 8, 9, and 10 each having through holes in wall surfaces thereof and different diameters are overlapped within the cylinder 4, and are rotated together at high speed. The number of the through holes within walls increases as one approaches the outer-most cylinder.

The liquid material is supplied to the interior of the cylinder 8 which is disposed inner-most among the overlapped cylinders 8, 9, and 10, and is thereafter sequentially moved via through holes formed in the wall surface of the cylinder 8 to internal wall surfaces of the cylinders 9 and 10 which are located on the outside of the cylinder 8, by a high centrifugal force. The portion to which the liquid material is supplied from the supply tube 11 is not limited to the center portion of the cylinder 8; however, the center portion is preferable. The amount of the liquid is divided among the through holes of which the number thereof increases when approaching the outer cylinders 9 and 10, thereby forming thin films. Then, these are supplied to the edges 6 and 7 of the slits 5, or to the front faces of the fins.

Even in the case in which the slits 5 are provided to the cylinder or even in the case in which the fins are provided to the cylinder, the liquid material controlled to be in an adequate amount by being passed through each of the through holes of the cylinders 8, 9, and 10, is supplied between the slits 5 of the internal wall surface of the cylinder 4, or between the fins.

Guiding channels for guiding the liquid material supplied from the though holes of the inner-most cylinder 8 to the plurality of through holes of the cylinder 9 may be provided on the inner wall surface of the cylinder 9 having through holes which divides the amount of the liquid, or may not be provided.

In the case in which the guiding channels are provided, it is possible to easily distribute the liquid films for obtaining fine particles of the liquid material to each of the slits 5 or fins on the outer-most cylinder 4 equally or in predetermined distribution ratios. However, the same results can be obtained without providing the guiding channels, if only the through holes of each of the cylinders 8, 9, and 10 are arranged adequately. The distribution can be made easily by dividing into two at each time; however, the number of dividing may be plural more than two may be adopted.

The number of the overlapped cylinders 8, 9, and 10 each having a role of distributing the amount of liquid using the through holes changes depending on the number of the slits 5 or the number of the fins which discharge the liquid films, the length of the slits 5 or the length of the fins, the amount of liquid finally necessary, and the like.

The gaps between the overlapping cylinders 8, 9, and 10 each having a role of distributing the amount of liquid using the through holes, by which the liquid material passes through, may be small enough gaps enough to enable the liquid material which is on the way toward being distributed to move while being pressed against the inner wall surfaces of the cylinders by the centrifugal force. FIG. 1 shows the external wall surfaces of the cylinders for distributing the amount of liquid closely contacting the inner wall surfaces of the outer cylinders; however, in actually, gaps therebetween are secured as flow passages for the liquid material which is on the way of being distributed.

Each of the through holes itself does not have a function of controlling the amount of liquid; therefore, the through holes needs not to be small through holes which cause difficulties in cleaning thereof or jamming.

It may be so arranged that a part of or whole of an apparatus having the same configuration as, or a part of or whole of an apparatus having different configuration from that of the present apparatus which controls and supplies the liquid material so as to provide it in an amount capable adequate for obtaining fine liquid droplets, is specially provided to the external of the cylinders; and the supply is made to the inner wall surface of the cylinder 4 having the slits 5 or the fins. However, there is no advantage to adopt it.

EXAMPLE 1

An Experiment of Making Dough for Making Bread Using a Small Apparatus

Strong wheat flour of 120 g was revolved at 1900 revolutions per minute along an inner wall surface of an outer cylinder having an inner wall surface having an internal diameter of 100 mm and an actual length of 94 mm; and liquid material in which a small amount of sugar, salt, and yeast were dissolved in water of 72 cc, was supplied from the rotational axis side through a fine-processing apparatus (a mixer) having a cutoff opening. As a result, dough for making bread in which water addition was completed and a water mixing was completed was obtained within 3.5 sec.

An operating condition of a fine processing mechanism for liquid material of the same apparatus at that time will be explained below.

Eight slits each having a rectangular shape having a length of 94 mm extending along the length of a cylinder and a width of 3 mm were arranged at constant intervals around the cylinder, which had a diameter of 57 mm, a length of 103 mm, and thicknesses of 2 mm at both ends thereof, such that the long sides thereof were orthogonal to the rotational direction of the cylinder. The thickness of the cylinder at the portion having the cutoff opening was 1 mm and was thinner than 2 mm. In this cylinder, a cylinder having a diameter of 53 mm, a length of 103 mm, and fifty six through holes, is overlapped; the through holes were arranged such that each of eight rows had seven through holes corresponding to a position between the cutoff openings of the cylinder located on the outside.

A gap between the inner wall surface of the cylinder having the cutoff openings and the outer wall surface of the inner cylinder on which the though holes are arranged is less than 1 mm. On the inner wall surface of the cylinder having fifty six through holes, guiding channels each having a depth of less than 1 mm are provided for guiding liquid material received from through holes of the inner cylinder to the fifty six through holes. Inside the cylinder having fifty six through holes, a cylinder having fourteen through holes, a diameter of 46 mm, and a length of 103 mm is overlapped. Positions of the fourteen through holes correspond to the positions of the guiding channels on the inner wall surface of the cylinder having fifty six through holes.

The three overlapped cylinders are rotated together with the cylinder having the cutoff openings at 12000 rounds per minute, and water of 72 cc is supplied from nozzles which supply liquid equally to the fourteen through holes, into the cylinder having fourteen through holes. Fine processing of the entire liquid material is completed in 3.5 seconds; the liquid material is discharged to the periphery of the cylinder having the cut off openings; thereby, the above-mentioned result is obtained.

EXAMPLE 2

Making Dough for Making Bread Using the Small Apparatus, and an Experiment of Making Bread Using the Dough This mixer for experimentation (a small apparatus) was delivered to a factory for making bread of a bakery of "P" company located in Chigasaki city, Kanagawa prefecture, and experiments of making bread in which three kinds of breads each having different material were made were performed.

An owner baker of "P" company, who is also a factory manager, periodically holds a workshop with bakers in the Tokyo metropolitan area or in the whole country of Japan, who seek products having high quality.

The baker was surprised to see that powder material such as wheat flour, and liquid material made of water, eggs, sugar, and salt became dough within only 3.5 seconds. The baker took the dough from the apparatus with his hands, and said "This dough is the same as that of which the water mixing is obtained by alternately putting wheat flour and liquid material into a container without using a mixer and leaving them one night."

"By the way, it is quite amazing that such dough can be produced within an extreme short time without need of putting it into a refrigerator in order to suppress abnormal fermentation of yeast, and without taking many hours of one night".

He repeated wording that "Please try touching the smoothness of this surface. This kind of smoothness cannot be obtained easily" at each fermentation process in a proofer.

Regarding the baked bread, the baker judged that "The crust is thin and crispy, while crumb has fine texture and rich elasticity. Every bread is worthy of winning a championship if entered into a competition."

"This mixer can realize identical bread-making which, through desired, has been impossible so far, and in which a water mixing process and a kneading process are completely separated."

"Not only for the case of French bread which should not be kneaded, but also for the case of other breads, this kind of perfect bread can be made, because fine quality of gluten formation can be made by kneading at a moment as required."

"Since unnecessary kneading can be eliminated, it will also be possible to realize new types of breads which can exhibit the tastes of the raw materials."

The baker gave a judgment that "We desire the earliest supply of commercial-type machines".

This bread-making experiment proved that breads having the highest quality, thought to be impossible thus far without advanced techniques or special methods of making, can be easily made using this mixer.

EXAMPLE 3

Experiment of Making Dough for Making Noodles, and Making Noodles

Medium-strength wheat flour of 120 g was revolved at 1900 rounds per minute using the same apparatus as described in the above Example 1, and liquid material in which a small amount of salt was dissolved in water of 60 cc was supplied from the rotational axis side, the same as in the method described in the above example 1. Dough was made in 3.5 seconds, and thereby, dough for making noodles having complete water mixing (i.e., a perfect mixing state was effected), was obtained. With this dough, just by kneading it within a short moment with both hands, noodles having high quality could be made by performing a manual processing method immediately after the dough was removed from the experimental apparatus. Adhesiveness of the dough or the noodles was extremely low comparing to conventional dough having a mixed water of 50%.

INDUSTRIAL APPLICABILITY

As has been described in the above-mentioned Example 1, Example 2, and Example 3, industrial applicability has already been proven. By adopting this inventive technology, a process of making breads and a process of making noodles are greatly quickened; and especially, in the process of making noodles, processing time will be shortened to, at least, less than 1/1200. This is due to the reason that additional processes for increasing the uniformity of water distribution after the mixing process become completely unnecessary. Furthermore, an advantage in facility cost reduction is also extremely effective since neither a kneader apparatus nor a compressing and couching and maturation apparatus, which have been utilized for performing additional processing, are unnecessary.

When making teuchi udon or at making tenobe men, no foot-stepping processing requiring close to 20 minutes after a mixing process or couching and maturation process is unnecessary. Therefore, there is no need to begin making dough many hours before making noodles. Accordingly, one can begin making dough when one desires. Advantages in industrial applicability are extremely high.

Blending and mixing, and a process requiring many hours are not suitable for mixing and combining powder material of a drug or industrial material and liquid material. Therefore, usefulness of the present invention, which enables complete mixing and combining within a short time, and does not have a blending-and-mixing effect, is high in industrial fields where mixtures or combinations are required.

By combining with a technology for making noodles disclosed in Japanese Unexamined Patent Application, First Publication No. 2004-337141 which has already been separately filed, making noodles such as pastas or noodles having high quality and many characteristics which have not been presented so far can be made with a small apparatus which has not existed so far, accordingly, enabling great change and advances in the industrial field of making noodles.

The mixer of the present invention has a simple structure; therefore, disassembling and assembling thereof are easy. Thus, maintenance and cleaning thereof are also easy. Accordingly, usefulness in industrial application is extremely high.

What is claimed is:

1. A mixer which combines a powder material and a liquid material, characterized in that:

the mixer comprises an outer cylinder into which the powder material is loaded, a rotational inner cylinder which is located coaxially with the outer cylinder and discharges the liquid material while forming the liquid material to fine particles, and a fin which has a rectangular shape and is disposed along an inner wall of the outer cylinder;

the fin is independently revolvable around the rotational inner cylinder; and the fin has side faces in a direction of revolution of the fin, each of which forms an inclined face such that a width of the fin becomes wider from an inner surface to an outer surface of the fin.

2. The mixer according to claim 1, wherein the fin is orthogonal to a direction of revolution of the powder material, and traverses the outer cylinder along the inner wall surface of the outer cylinder.

3. The mixer according to claim 1, wherein the fin forms a non-vertical angle with respect to a direction of revolution of the powder material, and traverses the outer cylinder along the inner wall surface of the outer cylinder.

4. The mixer according to claim 1, wherein the rotational inner cylinder comprises an opening through which an outside and an inside of the rotational inner cylinder communicate, and discharges a liquid film made of the liquid material using a centrifugal force in order to obtain fine particles made of the liquid material, and wherein the fine particles of the liquid material are obtained by discharging the liquid film from an edge of the opening.

5. The mixer according to claim 4, wherein:

a plurality of cylinders each having through holes formed on a wall surface through which the liquid material passes are combined inside the rotational inner cylinder having the opening;

the number of the through holes increases when approaching the outer-most cylinder;

a liquid amount of the liquid material is divided among the through holes of which the number thereof increases while the liquid material supplied from the inner-most cylinder is moved to the outer-most cylinder through the through holes by a centrifugal force accompanying rotation of the cylinders; and the fine particles of the liquid material are obtained by discharging the liquid film from the edge of the opening of the outer-most cylinder.

* * * * *